US010317171B2

(12) United States Patent
Odle et al.

(10) Patent No.: US 10,317,171 B2
(45) Date of Patent: Jun. 11, 2019

(54) SYSTEM FOR SIGHT ADJUSTMENT

(71) Applicant: General Manufacturing, LLC, Columbia, MO (US)

(72) Inventors: Nathan Odle, Columbia, MO (US); Sam Campbell, Columbia, MO (US); Richard Martin, Columbia, MO (US)

( * ) Notice: Subject to any disclaimer, the term of this patent is extended or adjusted under 35 U.S.C. 154(b) by 0 days.

(21) Appl. No.: 15/614,501

(22) Filed: Jun. 5, 2017

(65) Prior Publication Data

US 2017/0350674 A1 Dec. 7, 2017

Related U.S. Application Data

(60) Provisional application No. 62/346,432, filed on Jun. 6, 2016.

(51) Int. Cl.

| | |
|---|---|
| ***F41G 1/033*** | (2006.01) |
| ***F41G 1/01*** | (2006.01) |
| ***F41G 1/08*** | (2006.01) |
| ***F41G 1/26*** | (2006.01) |

(52) U.S. Cl.

CPC ..... *F41G 1/01* (2013.01); *F41G 1/033* (2013.01); *F41G 1/08* (2013.01); *F41G 1/26* (2013.01)

(58) Field of Classification Search

CPC ... F41G 1/02; F41G 1/033; F41G 1/04; F41G 1/06; F41G 1/16; F41G 1/26; F41G 1/28

See application file for complete search history.

(56) References Cited

U.S. PATENT DOCUMENTS

| | | | | |
|---|---|---|---|---|
| 4,686,770 A * | 8/1987 | Aigner | ..... | F41G 1/26 42/137 |
| 6,886,289 B1 * | 5/2005 | Rigler | ..... | F41G 1/033 42/136 |
| 2011/0308132 A1 * | 12/2011 | Hewes | ..... | F41G 1/033 42/135 |

FOREIGN PATENT DOCUMENTS

DE 10 2014 019 273 * 6/2016

* cited by examiner

*Primary Examiner* — Stephen Johnson
(74) *Attorney, Agent, or Firm* — The Law Firm of Brett M. Maland

(57) ABSTRACT

The current system is a method for easily adjusting the front sight post on a firearm. The system is used to aid in easier front sight post adjustments as well as maintain a uniform sight picture throughout the aiming process. The system solves the current problem of viewing two separate sight pictures when looking through a rear sight. The system also solves the problem of needing a separate tool to adjust the sight post. The system includes four critical parts, a bottom sight post tower, a top sight post tower, a front sight post and a mechanism for providing constant upward force such as a spring. The system has multiple embodiments including the use of various sight posts.

10 Claims, 8 Drawing Sheets

SYSTEM FOR SIGHT ADJUSTMENT

CROSS REFERENCE TO RELATED APPLICATION

This application claims priority to U.S. Provisional Application No. 62/346,432 of the same title and filed Jun. 6, 2016.

FIELD

This invention relates to firearm accessories, specifically to the sights and the corresponding sight pictures.

BACKGROUND

Back up iron sights have existed for many years to provide a sturdy and purely mechanical method for aligning a shooter's line of vision with a bullet's trajectory. Over those years, advances have been made to increase the durability, aesthetics, and function of back up iron sights. The basic components of sights have stayed the same, namely an aperture in the rear of the gun to narrow the vision and provide the first point of alignment as well as a post in the front of the rifle to provide the second point of alignment with the target. When the eye, aperture, post, and target are all aligned in a line of sight, then the flight path of the bullet is determined and an effective shot can be made. A major factor in how well a shooter will perform is how intuitive sights are to align. If there are inconsistencies in the relative positions of the different sight components that result from range adjustments, wind adjustments, ammunition adjustment, or any other adjustment made to the front sight, then a shooter may become unconsciously biased by lining up components of the sight that are not intended to be aligned.

Frequently, front sight posts are protected with a surrounding housing, commonly referred to as "ears", that prevents the post from being moved or damaged should the firearm be dropped or come into contact with foreign objects. This protective housing is not intended to create a line of sight on a state of the art front sight. However, the ears on this protective housing or tower provides an extra alignment point, which can improperly be relied upon by the shooter.

The front sight post must be adjusted for each individual rifle and readjusted to accommodate change in ammunition as well as many other factors if maximum accuracy is to be held. When the front sight is adjusted it changes position with respect to the ears of its protective housing, thereby changing what is seen when looking through the rear sight aperture. The ears surrounding the front sight post do not currently move along with the front sight post to provide continuous alignment. Only the sight post adjusts up and down while the protective ears remain in one position.

A standard sight picture will have two points of visual alignment. The first point that creates the alignment is the front sight post in the center of the rear aperture. The second, which is often incorrectly relied upon by the person aiming the firearm, would be the "ears" of the housing or apparatus that surrounds the sight post, depending upon the front sight, with the rear aperture. A person aiming the firearm often incorrectly relies on the position of the tower unconsciously, particularly if that person often shoots at a constant distance, as may occur at a shooting range.

Current systems typically utilize a front sight detent to ensure the front sight post does not move after adjustment. While effective at keeping the front sight post from moving, it increases the difficulty of adjusting the front sight. A special front sight adjustment tool or an improvised tool such as a bullet must be used to depress the detent, hindering the ability of the operator to turn the front sight post.

SUMMARY

The system described herein provides a front sight that adjusts the height of the protective housing when the front sight post is adjusted, thereby maintaining consistent alignment between the two. When looking through a rear sight aperture at the front sight, the front sight post can be aligned and in doing so, the arms of the tower of the front sight will also be aligned. This system also provides for a very intuitive and visually pleasing coaxial view which lines up multiple similar shapes enhancing a shooter's ability to shoot on target and making target acquisition quicker because the shooter can safely rely on two positioning elements on the front sight, those elements being the front sight post as well as the ears of the protective housing.

To provide precision alignment in the front sight, a system is utilized wherein the protective housing is separated into multiple components. The lower component is connected to the front sight base to provide the stability and adjustments needed when connecting to the firearm. The upper component provides protective ears around the front sight post and adjusts along with the lower component while simultaneously adjusting along with the front sight post. When no pressure is applied to the upper component, the top tower rests against the sight post making the top tower and the front sight post a stable system. The top tower is moved downward towards the bore of the firearm to adjust the sight post but will return to its standard position resting against the sight post when released. The ability of the top tower to return to its resting position against the front sight post, allows for continuous coaxial alignment between the sight post and the center of the top tower regardless of the height of the front sight post.

The continuous alignment of the system removes the problem of misalignment due to conflicting sight pictures when the firearm is raised and the shooter looks through the sights. A standard sight picture will have two aliment views. The first being the front sight post in the center of the rear aperture. The second, which is incorrect, would be the tower or apparatus that surrounds the sight post, depending up on the front sight, with the rear aperture. The proposed system removes this problem by making both sight pictures one.

A secondary advantage provided by the system is the ability to adjust the sight post with no tools. In a standard AR-15 front sight, a detent bar must be depressed in order to move the sight post. In the currently disclosed system, one hand is used to depress the tower top while the operator's second hand is used to rotate the sight post. The ability to move the sight post while having no tools available increases the intuitive nature of the system and allows the system to be adjusted quicker and with less confusion.

BRIEF DESCRIPTION OF DRAWINGS

The construction designed to carry out the system will hereinafter be described, together with other features thereof.

The system will be more readily understood from a reading of the following specification and by reference to the accompanying drawings forming a part thereof, wherein an example of the system is shown and wherein.

DETAILED DESCRIPTION OF DRAWINGS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 1:
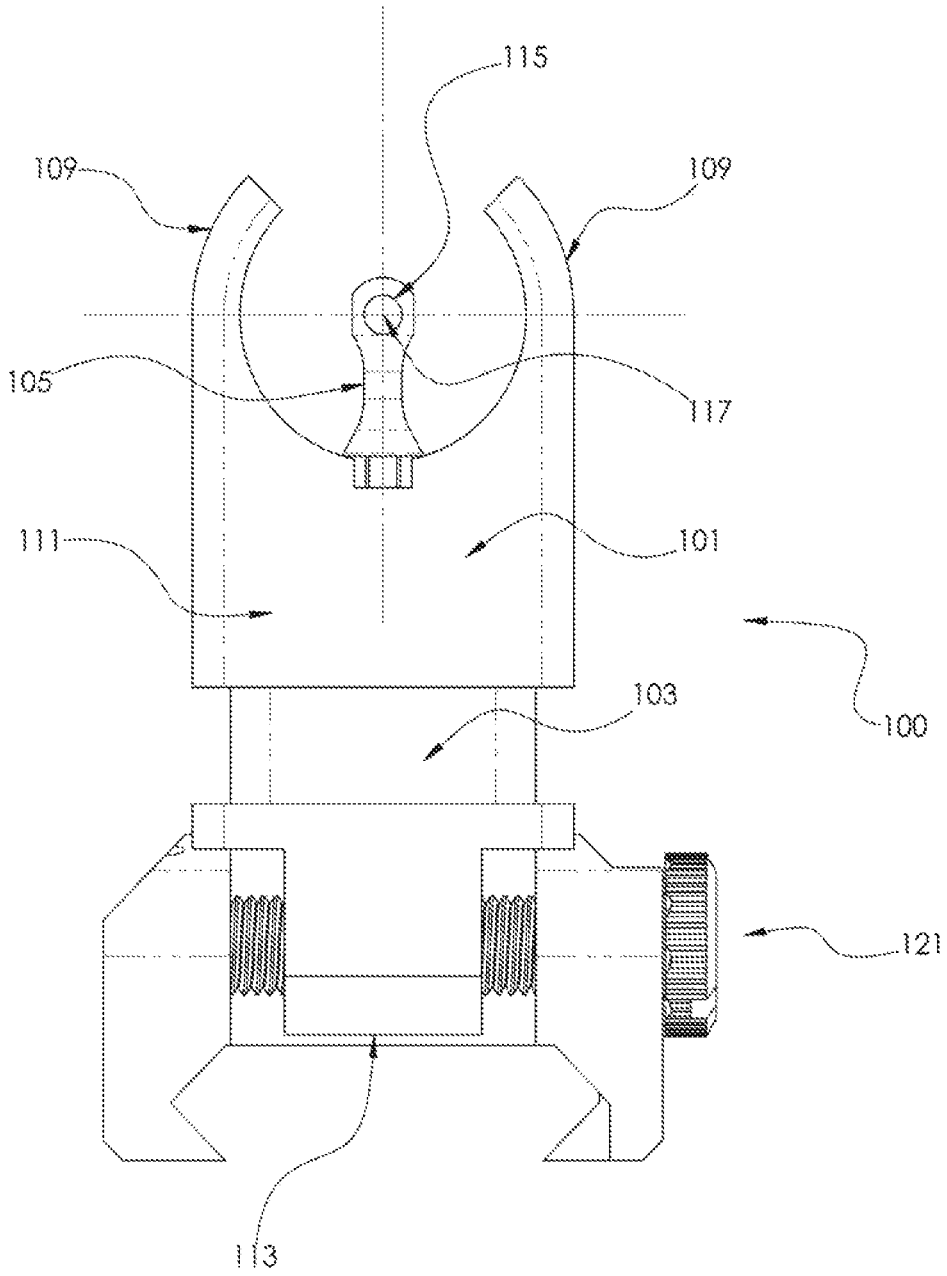
FIG. 1 is a front view of one embodiment of the system showing the components involved.

FIG. 1 displays a front sight mechanism 100 that can be attached to a firearm 400 by means of a base 113. The base 113 attached to a firearm in ways known in the art. In a preferred embodiment, the sight mechanism is specifically designed for highly customizable firearms, and more specifically the AR-15, which typically has a threaded end. The sight mechanism can be attached directly to the threaded end of the barrel, or it can clamp around the barrel or an extension to the barrel. The system features a lower tower 103, a top tower 101, and a sight post 105. The top tower has a plurality of ears, most preferably two ears 109 that at least partially enclose and protect the top of the sight post. In a preferred embodiment, when the top tower 101 is in a resting position, the ears form about ¾ circle (270 degrees) around the top of the sight post, with the target location 115 on the sight post in the direct center or centroid 117 of the partial circle created by the ears 109 of the top tower 101. This invention allows the shooter to sight the firearm, and then it allows for the shooter to make further adjustments later while still maintaining the target location 115 on the sight post 105 to be lined up with the centroid 117 of the top tower 101. This sort of configuration helps the shooter to focus better and ultimately leads to better accuracy for the shooter. This accuracy is further enhanced in how the front sight 100 interacts with the rear sight 401 to create a line of sight with two additional reference points in addition to the centroid 117 and the target location 115 of the front sight for a total of four reference points. The center is referred to as a centroid because the ears do not need to form a partial circle, but could also form a full circle or other geometric shapes in other embodiments. Due to the innovations disclosed herein, the front sight post target location 115 or hole lines up in the centroid 117 created by the ears 109 even after adjustments are made to the elevation or windage of the front sight. Windage, or side to side movement of the sight, is controlled by the windage knob 121. Elevation, or vertical movement of the sight post which is adjusted for different shot distances, is controlled by rotating the sight post 105 while pushing down on the top tower 101.

Figure 3:
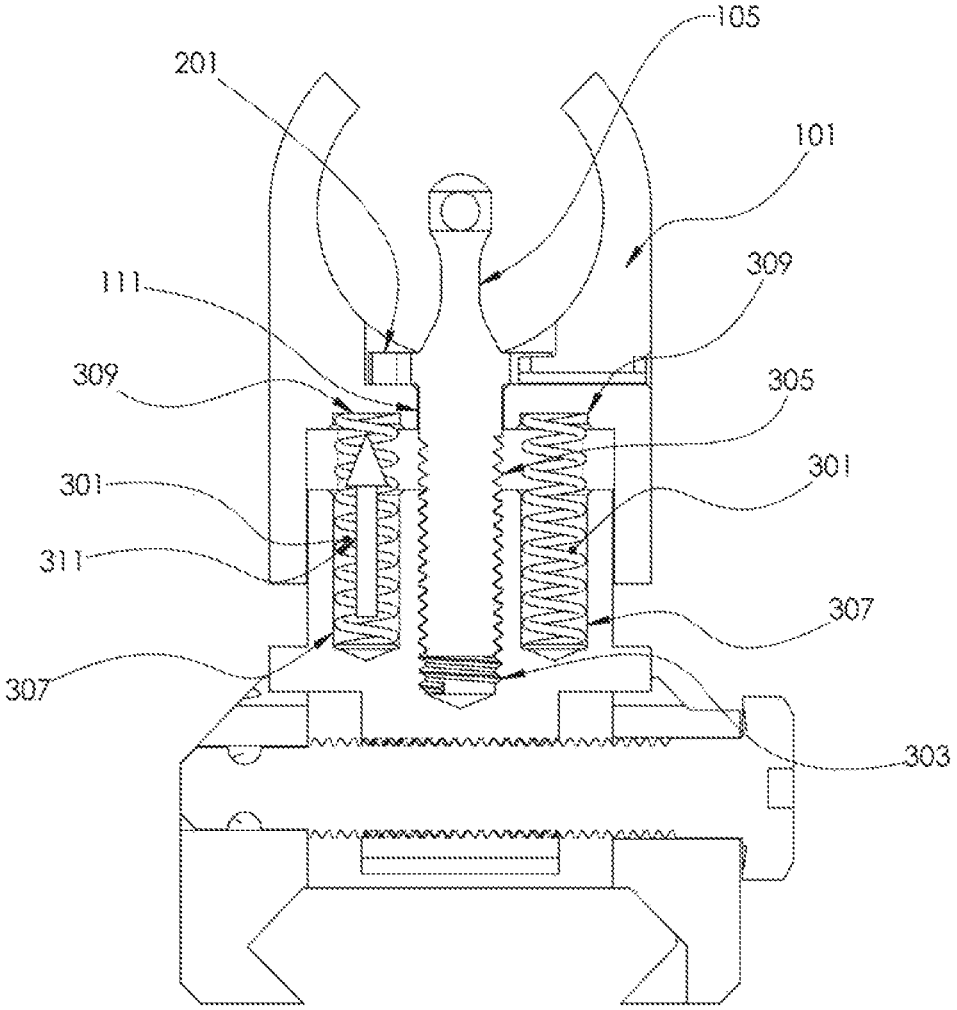
FIG. 3 is a cutaway view of one embodiment of the system showing the components involved in the system including the internal springs.

The top tower 101 of the front sight moves relative to both the sight post and lower tower, but the range is limited by flange on the sight post. Turning to FIG. 3, the sight post 105 fits inside a cylindrical hole 111 on the top tower 101. The sight post 105 has bottom segment with a threaded end 303 that fits into a threaded opening 305 on the lower tower 103. The lower tower 103 also has one or more other openings, or sockets 307, that hold springs 301 and match up one or more spring contact points 309 on the top tower 101 to create an upward force 311 on the top tower 101. In this configuration, the top tower 101 moves like a washer on a bolt, with the lower tower 103 being the nut and the sight post 105 being the bolt. In the disclosed invention, the spring contact points can be part of the lower tower 103 or the top tower 101 and the sockets can be part of the lower tower 103 or the top tower 101. However, other embodiments could allow for this to be reversed.

Figure 5:
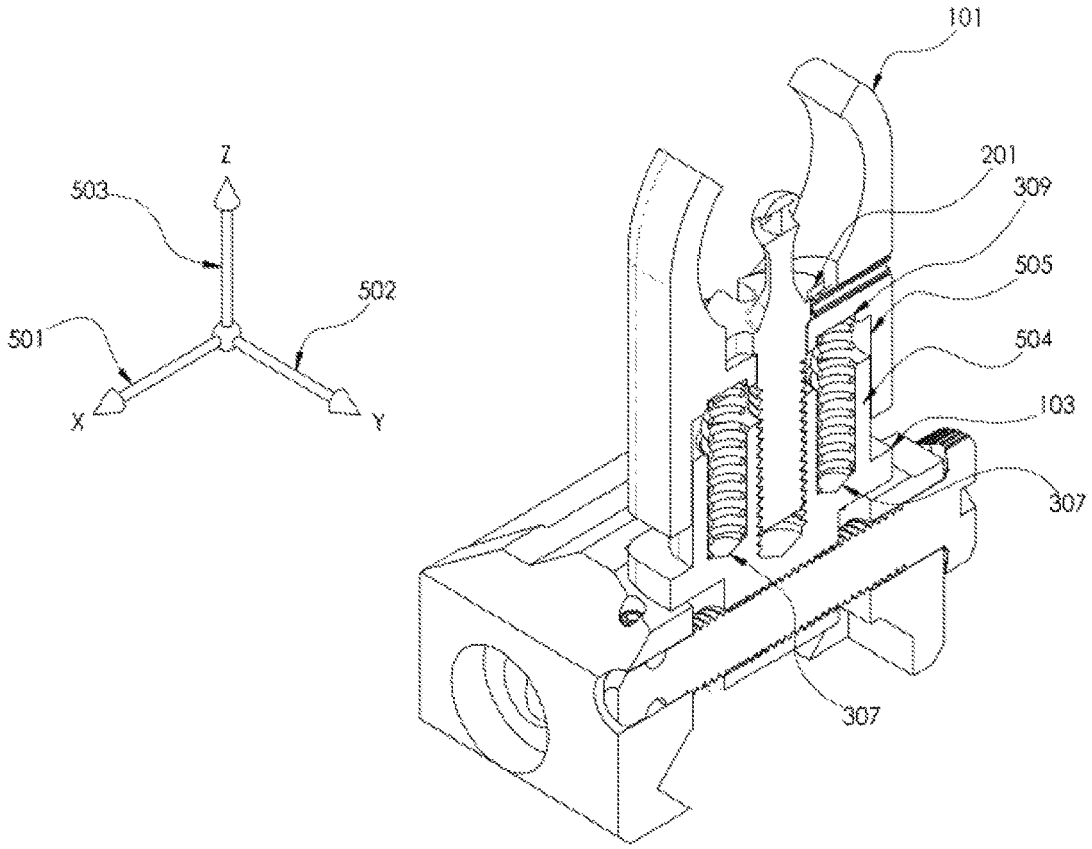
FIG. 5 is an isometric view of the front sight.

The top tower 101 is fixed relative to the lower tower 103 in the x plane 501 and the y plane 502, but movement is allowed in the z plane 503 which is the vertical plane when in use, as shown in FIG. 5. In the preferred embodiment, the lower tower has a non-circular extension 504 that fits into an insertion opening 505 sized and shaped to fit the non-circular extension 504. In other embodiments, there can be more than one extension and corresponding insertion openings, and the extension and corresponding insertion openings can be on the top tower or the lower tower.

Figure 4:
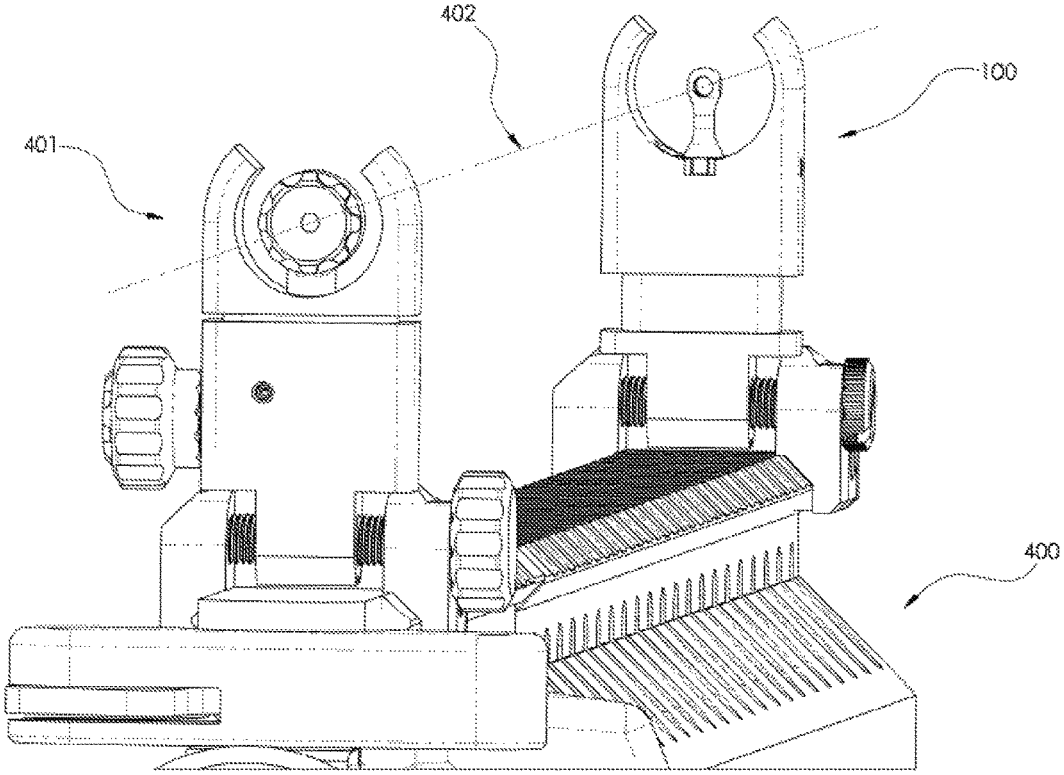
FIG. 4 is a view of the front sight on a firearm.
Figure 8:
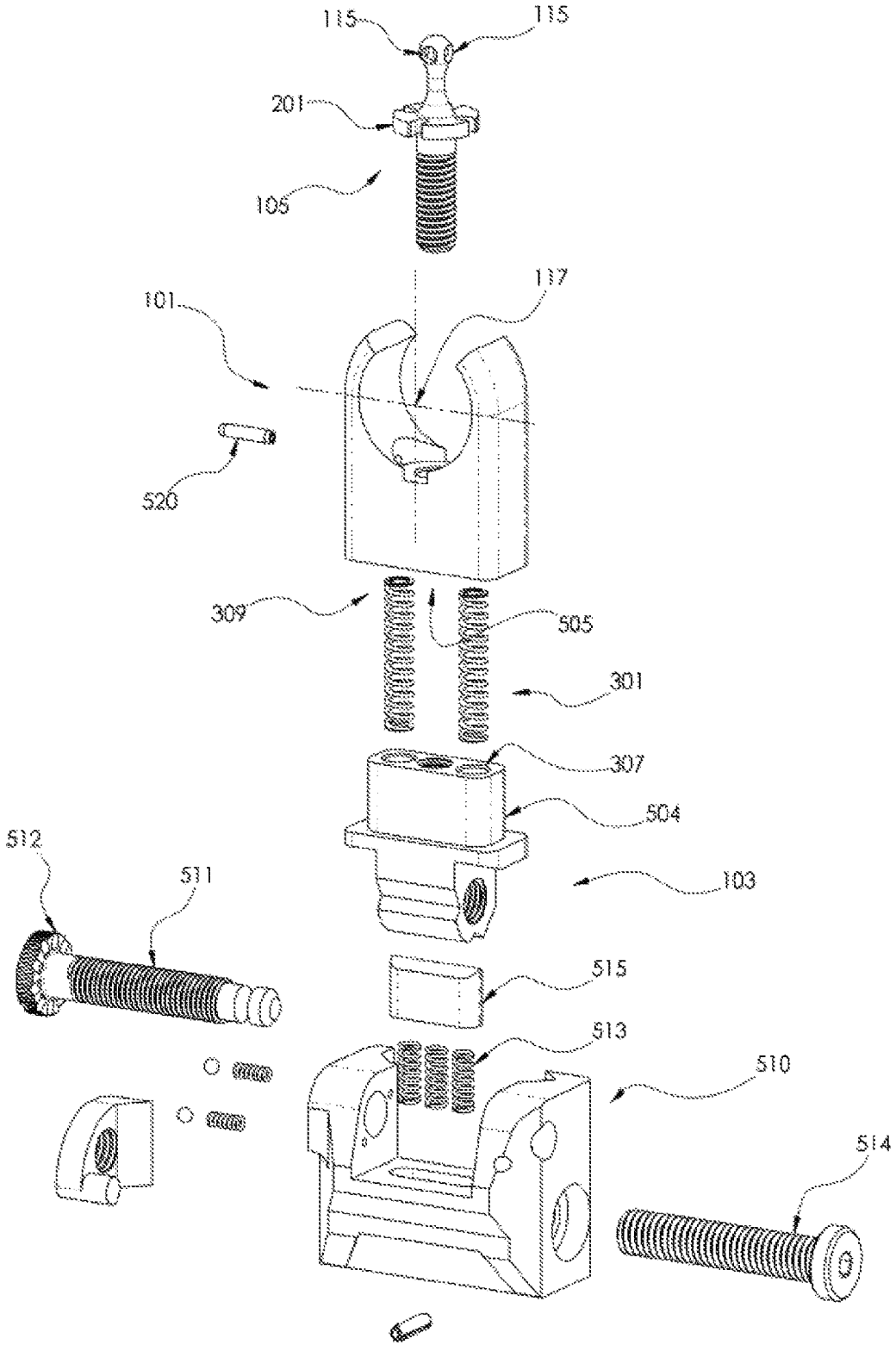
FIG. 8 is an isometric view of the front sight.

In the preferred embodiment, the sight post 105 has a sighting location comprised of two holes 115 on the upper portion of the sight post shown most clearly in FIG. 8. Referring to FIG. 4, the shooter using the firearm 400 will have a line of sight 402 through a rear sight 401 that goes through the sighting location 115 on the upper portion of the sight post so that the target is aligned with both the rear sight 401 and the upper portion of the sight post 105. As stated, in the preferred embodiment, the sighting location 115 is comprised of two circular holes. The fact that the sighting location 115 is comprised of two holes allows the shooter to have a line of sight with only a one quarter turn of the front sight post.

The front sight has an attachment section 113 designed to lock directly on to the gun bore or by locking on to some other gun accessory that is directly fixed to the gun bore. The attachment section 113 can be attached by any methods known in the art. FIG. 8 shows an alternative attachment means or base 510.

The vertical movement of the top tower 101 relative to the lower tower 103 is further limited by a flange 201 or lip in the middle segment of the sight post. The flange 201 is larger than the cylindrical hole 111 in the upper tower. The flange 201 does not need to be a full circle, but it must be configured to not pass through the cylindrical hole 111 on the top tower 101. Additionally, one or more springs 301 sit in the one or more sockets 307, and push on the one or more spring contact points 309 so that to push the top tower 101 against the lip 201 of the sight post 105. The springs 301 can be compression springs, compression washers, or other means known in the art for applying constant pressure. In a preferred embodiment, the one or more springs are sized to apply less than fifty newtons of force in total, but more than one quarter of a newton all together.

Figure 2:
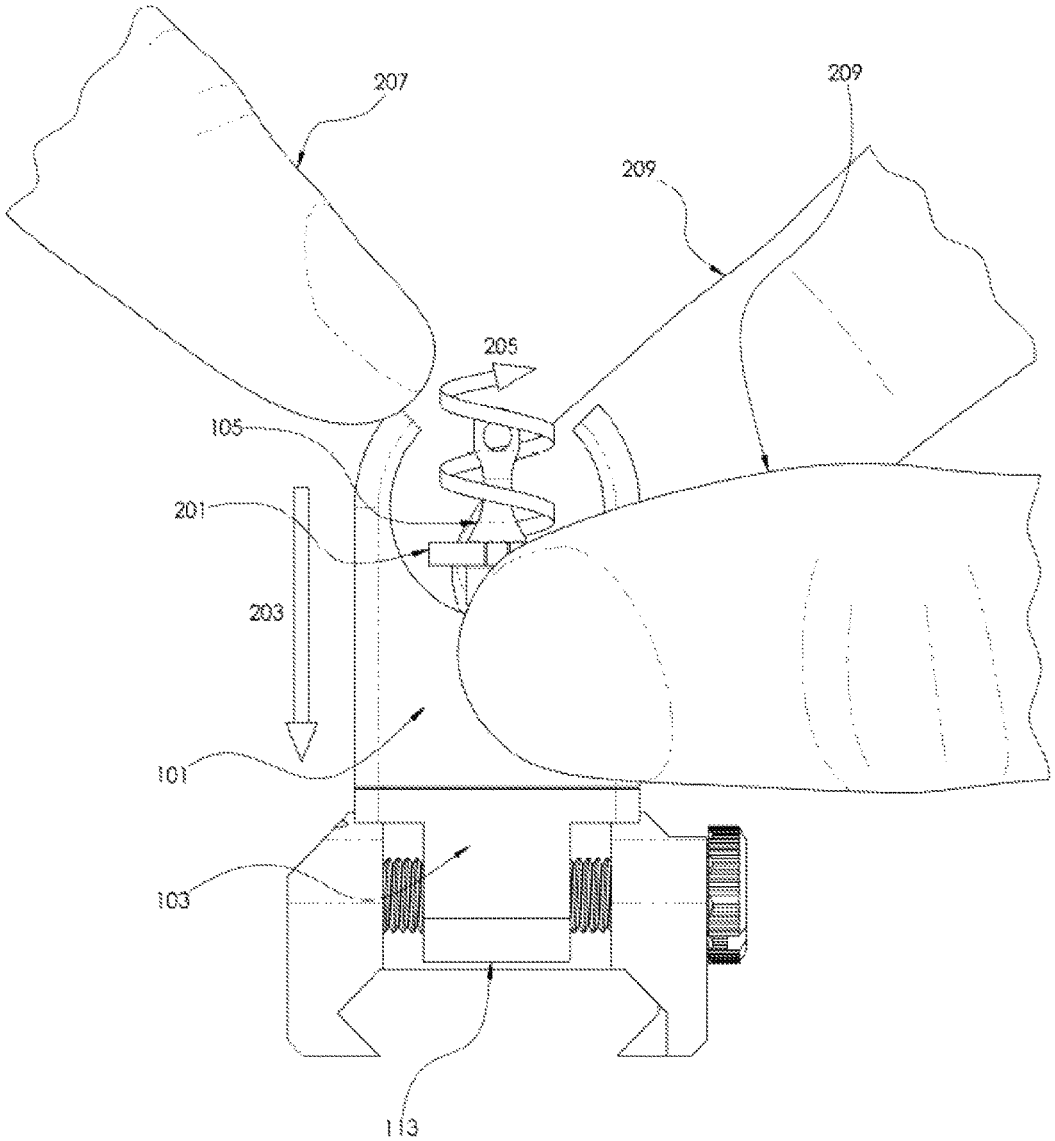
FIG. 2 is a front view of one embodiment of the system describing the motion carried out make the system work.

FIG. 2 demonstrates use of the front sight 100. When the front sight 100 needs to be adjusted, a user must apply downward pressure 203 on the top tower 101 to disengage it from the flange 201 of the sight post 105. That downward pressure 203 must be greater than the pressure applied by the one or more springs and can be applied by one finger on a first hand 207 of the person using the firearm. The user can change the level of the top tower 101 by turning 205 the sight post 105 clockwise or counterclockwise, so that it moves up or down relative to the lower tower 103. The user can turn the sight post 105 using two fingers on a second hand 209. After the sight post 105 is at the desired level, the user can release the downward pressure 203 on the top tower 101 by releasing the one finger 207 so that the top tower 101 will move up to the flange 201 of the sight post.

The rotation adjusts the level of the sight post and the flange 201 relative to the lower tower 103, wherein the lower tower is fixed relative to the gun bore. Since the distance between the flange 201 and the sighting location (one of the two holes in the front sight post) 115 on the sight post 105 is also fixed, then the position of the sighting location 115 on the sight post 105 relative to the upper tower is also constant, as long as no downward pressure 203 is applied to the upper tower in an amount greater than the upward force 311 created by the springs. This allows for the firearm user to always see a consistent image of the sighting location 115 on the sight post 105 relative to the partially enclosing ears 109 of the upper tower. In other words, the position as indicated by the dotted lines 117 of the sighting location 115 is constant. This consistency allows for greater firing accuracy as it eliminates the natural and sometimes unconscious bias encountered by shooters using the state of the art front sight.

FIG. 2 shows the adjustment method used by the system when elevation needs to be adjusted to match the point of impact of the bullet. The top tower 101 is moved downward against compression springs 301 into the lower tower 103. While the top tower 101 is still being held down the sight post 105 is rotated either clockwise or counterclockwise to change its height in relation to the lower tower 103 and thereby changing the point of aim to match the point of impact. The top tower 101 is then released and is pushed upward by the compression springs 301. The top tower 101 is once again held securely against the sight post 105 due to the compression springs 301 securely locking the sight post 105 into its new position while maintaining concentricity between the top tower 101 sight picture and the sight post 105 sight picture.

As stated above, the front sight allows for the target location 115 to be in the centroid 117 of the front sight ears 109 for two reference points that are aligned even after adjustments are made. This front sight is part of a sighting system that also includes a rear sight 401 that also has a sight hole with a center 612 and a centroid 650 that provide two additional reference points after sighting adjustments are made and the system is further clocked for specific shot circumstances of windage and distance. This allows for the invented sighting system to create a constant set of reference points which allow for greater shooting accuracy. A total of four reference points are employed with this invention.

Figure 6:
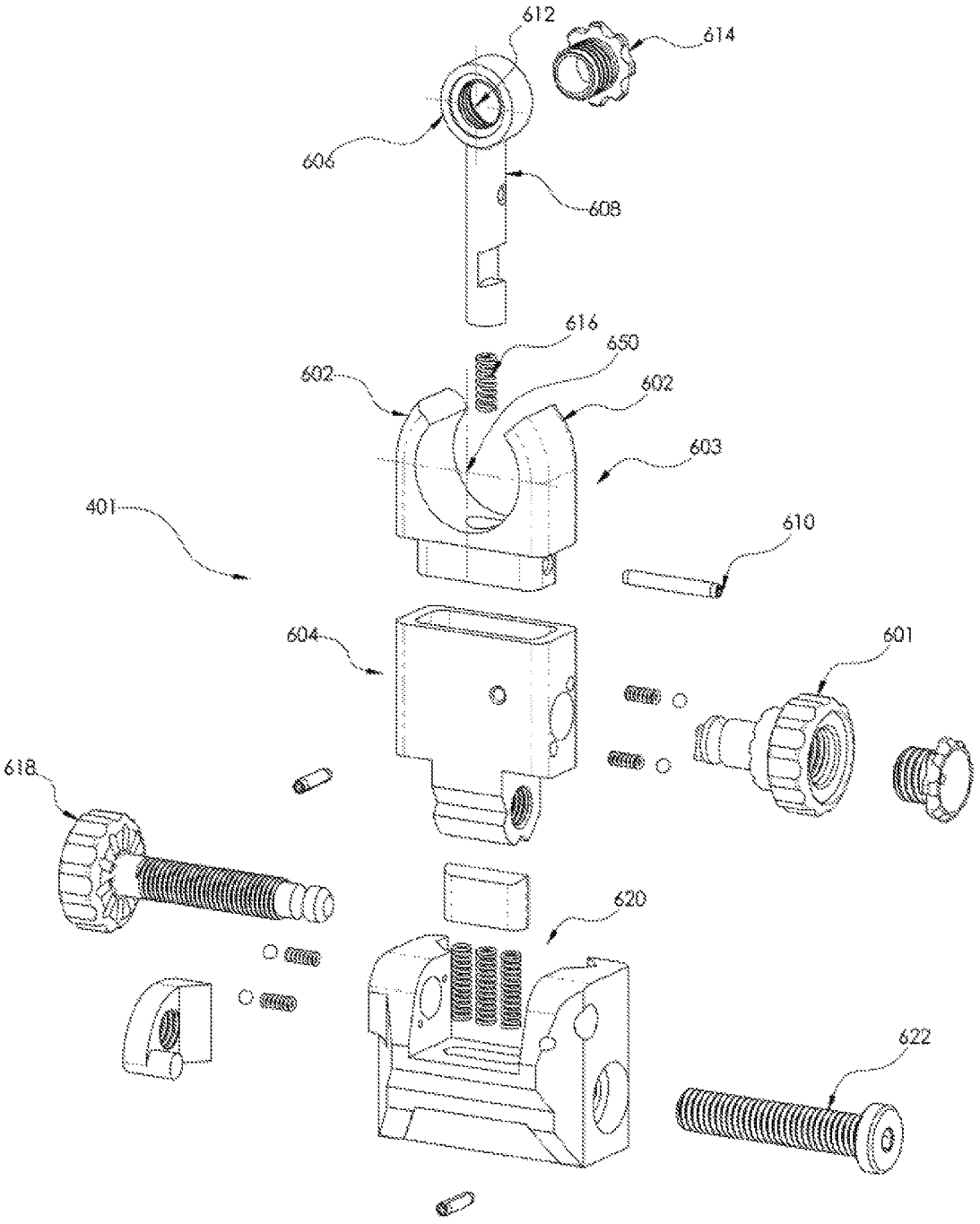
FIG. 6 is an isometric view of the rear sight.

In referring to FIG. 6 showing the preferred embodiment of the rear sight, the rear sight is comprised of a rear sight post 608 that moves independently relative to the rest of the rear sight 401. The rear sight is also comprised of an upper tower 603 and a lower tower 604. The upper tower 603 has ears 602 that form an additional reference point around a sight hole 606 having a centroid 612. The ears 602 also have a centroid 650. The position of the centroid 612 of the sight hole 606 can be easily locked into the centroid 650 of the ears 602 with a locking means 610 such as a spring pin that locks to a locking point on the rear sight post 608. A spring 616 acts upon the sight post 608, pushing the rear sight post 608 away from the lower tower 604. The upper tower 603 moves vertically independently of the lower tower 604. An elevation knob 601 controls the level of the upper tower 603 and the rear sight post 608. The elevation knob 601 has an action point 642 that acts upon a cam (shown as 702 in FIG. 7). The cam has a progressive radius that adjusts the height of the rear sight post and an upper tower at standard distances with equal turns. The progressive radius of the cam 702 is specific to the caliber of the bullet. The cam 702 can be changed out for specific calibers. The progressive radius of the cam allows for consistent turn lengths or consistent fractions of turns to match up with consistent changes in distance. This allows, for example, for $1/16^{th}$ turns to always match up with changes of distance of 100 yards. Current state of the art AR-15 sighting systems do not allow for this.

Figure 7:
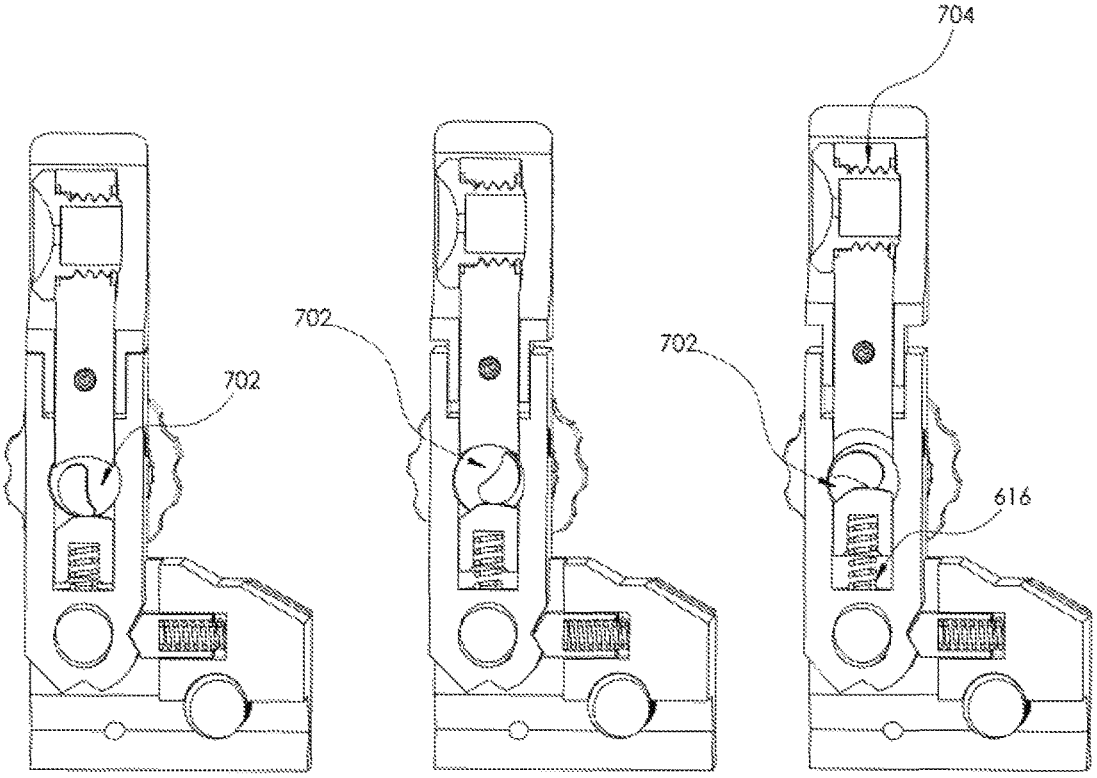
FIG. 7 is a side view of the rear sight.

The elevation knob 601 has an opening to receive an aperture insert 614. In the preferred embodiment, the aperture insert 614 screws into the elevation knob 601, and will also screw into the sight hole 606 (the sight hole 606 contains threads 704 as shown in FIG. 7). This provides a storage mechanism for a second aperture for changing the aperture of the sight hole 606.

The unique features of this sighting system are coupled with a unique method for sighting a firearm employing the presently disclosed sighting system. The following steps comprise the preferred embodiment of the procedure for sighting and shooting a firearm employing the presently disclosed sighting system:

1. Use the windage knob 618 of the rear sight 401 so that the rear sight is in the center of the adjustment range.

2. Use the elevation knob 601 of the rear sight to put the rear sight on the lowest setting. The rear sight is at the lowest setting when turning the knob in the lowering direction does not lower the upper tower 602.

3. Place a target at a first predetermined target shooting distance from the shooter. This first predetermined target distance is 25 yards in the preferred embodiment. Use only the windage knob 121 and elevation adjustment 115 on the front sight to shoot at least one bullet a first predetermined test distance low of center. This first predetermined test distance is 1.4 inches in the preferred embodiment. The elevation is adjusted by rotating the front sight post 115. After at least one bullet strikes the target distance that the first predetermined test distance low of center (it should not be to the right or the left), then proceed to the next step. If the desired point below the center is not hit, the shooter should adjust the windage knob 121 if the shooter is hitting left or right of the target and should adjust using the elevation adjustment 115 to correct in the vertical direction.

4. Place the target at a second predetermined target shooting distance from the shooter. This second predetermined target shooting distance is 50 yards in the preferred embodiment. Use only the windage knob 121 and elevation adjustment 115 on the front sight to shoot at least one bullet a second predetermined test distance low of center. This second predetermined test distance is 0.4 inches in the preferred embodiment. Repeat as necessary.

5. Place the target at 200 yards to confirm zero. If zero is not confirmed, repeat steps 2 through 5.

The remaining steps are for shooting after the firearm has been sighted:

6. Use the numbers or clicks on the elevation knob 601 of the rear sight to adjust for desired distance.

7. Use the windage knob 618 of the rear sight to adjust for wind drift.

FIG. 8 is an isometric view of the front sight showing the four holes 115 in the front sight post. The front sight has a clamping screw 514 for attaching to the base 510 to the firearm. The front sight also has springs 513 and a detent bar 515.

The invention described herein can be manufactured by machining and made by metal, alloy and polymer materials practiced in the art.

We claim:

1. A firearm sighting system comprising a front sight and a rear sight, the front sight further comprising a top tower structured to at least partially enclose a sight post, the sight post having a lower segment with threads, a middle segment with a flange, and an top segment, and a lower tower having threaded opening for receiving the lower segment of the sight post and an attachment connection structured to attach to a gun bore, wherein the top tower is structured and operable to be fixed relative to the lower tower in a x plane and a y plane and to have restricted movement in a z plane wherein the restricted movement in the z plane of the top tower is restricted by the flange wherein the sight post is coupled to the lower tower via the threads on the lower segment of the sight post mating to the threaded opening on the lower tower.

2. The firearm sighting system of claim 1, wherein the front sight further comprises one or more springs structured and operable to apply an opposing force between the top tower and the lower tower in the z plane.

3. The firearm sighting system of claim 2, wherein the one or more springs apply a force of greater than one quarter of a newton.

4. The firearm sighting system of claim 1, wherein the top tower is structured to at least partially enclose the sight post by means of two ears forming an enclosure of 180 degrees or more.

5. The firearm sighting system of claim 1, wherein the lower tower has an extension configured to fit inside the top tower and is structured and operable to be fixed relative to the top tower relative to the lower tower in the x plane and the y plane.

6. The firearm sighting system of claim 1, wherein the rear sight is structured and configured with a rear sight aperture and arms at least partially enclosing the rear sight aperture, the arms having a centroid.

7. The firearm sighting system of claim 6, wherein the rear sight aperture is structured and configured so that the rear sight aperture is located at the centroid of the arms.

8. A sighting system comprising a rear sight and a front sight, the front sight further comprising an upper tower with ears having a centroid, a front sight post structured and configured to provide a shooter with a line of sight to the target and to be sighted with quarter turns, the line of sight being in the centroid of the upper tower and with the front sight post capable of moving independently from the upper tower, and the rear sight further comprising a top tower and a rear sight post, the rear sight post structured and configured to raise vertically with the turn of a rear knob, the rear knob configured to receive and store an aperture insert, the rear knob further configured to act on a variable cam having a progressive radius.

9. The sighting system of claim 8, wherein the rear sight is further comprised of a lower tower, the top tower configured to move vertically relative to the lower tower and structured with ears that partially encircle a sight hole on a rear sight post, the ears having a centroid, the rear sight post structured and configured to move vertically and independently of the top tower.

10. The sighting system of claim 9, wherein the sighting system is configured to be sighted to create a line of sight at a plurality of adjustments wherein the front sight post is positioned in the centroid of the ears of the front sight, and the rear sight post is positioned in the centroid of the ears of the rear sight so that a line of sight is comprised of four centered reference points.

* * * * *